US008334741B2

(12) United States Patent
Eriksson et al.

(10) Patent No.: US 8,334,741 B2
(45) Date of Patent: Dec. 18, 2012

(54) SWITCHING DEVICE

(75) Inventors: Lars Eriksson, Västerås (SE); Mats Johansson, Västerås (SE)

(73) Assignee: ABB AB (SE)

( * ) Notice: Subject to any disclaimer, the term of this patent is extended or adjusted under 35 U.S.C. 154(b) by 0 days.

(21) Appl. No.: 13/363,530

(22) Filed: Feb. 1, 2012

(65) Prior Publication Data

US 2012/0126916 A1 May 24, 2012

Related U.S. Application Data

(63) Continuation of application No. PCT/EP2009/060082, filed on Aug. 4, 2009.

(51) Int. Cl.
*H01H 9/02* (2006.01)

(52) U.S. Cl. ..... 335/202; 335/132

(58) Field of Classification Search ..... 335/202
See application file for complete search history.

(56) References Cited

U.S. PATENT DOCUMENTS

| | | | | |
|---|---|---|---|---|
| 2,896,045 | A * | 7/1959 | Daniel Brunicardi | 335/187 |
| 4,100,517 | A | 7/1978 | Rodolfi | |
| 4,580,005 | A * | 4/1986 | Minks et al. | 174/17.07 |
| 4,724,410 | A * | 2/1988 | Degenhart | 335/132 |
| 6,188,036 | B1 * | 2/2001 | Arnold | 218/157 |
| 6,531,941 | B1 * | 3/2003 | Greenberg et al. | 335/202 |
| 6,642,823 | B2 * | 11/2003 | Passow | 335/132 |
| 6,778,048 | B1 * | 8/2004 | Brignoni et al. | 335/132 |
| 7,358,837 | B2 * | 4/2008 | Puskar et al. | 335/6 |
| 7,474,182 | B2 * | 1/2009 | Bolz et al. | 335/131 |
| 7,482,901 | B2 * | 1/2009 | Watanabe et al. | 335/201 |
| 7,609,137 | B2 * | 10/2009 | Roesner et al. | 335/202 |
| 7,683,745 | B2 * | 3/2010 | Gouhl et al. | 335/13 |
| 7,748,105 | B2 * | 7/2010 | Kinzler et al. | 29/622 |
| 7,872,551 | B2 * | 1/2011 | Nakamura et al. | 335/4 |
| 2002/0027489 | A1 * | 3/2002 | Letient | 335/202 |
| 2006/0152312 | A1 * | 7/2006 | Stanke et al. | 335/202 |
| 2010/0001820 | A1 * | 1/2010 | Fancke | 335/202 |

FOREIGN PATENT DOCUMENTS

| | | |
|---|---|---|
| GB | 2236618 A | 4/1991 |
| WO | 02086928 A2 | 10/2002 |

OTHER PUBLICATIONS

International Search Report and Written Opinion of the International Searching Authority; Application No. PCT/EP2009/060082; Issued: Mar. 23, 2010; Mailing Date Apr. 1, 2010; 8 pages.

* cited by examiner

*Primary Examiner* — Elvin G Enad
*Assistant Examiner* — Lisa Homza
(74) *Attorney, Agent, or Firm* — St. Onge Steward Johnston & Reens LLC

(57) ABSTRACT

A mechanical switching device including a base member, at least one pair of elongated conductor members mounted on the base member, each conductor member including a conductor end, wherein the conductor ends of the pair of conductor members are separated by a gap, a middle member mounted on the base member, a switch member including a stationary part and a movable part, the movable part including a conductor bridge. The stationary part includes a protruding member protruding away from the direction of displacement of the conductor bridge, wherein the base member, the conductor members, the middle member and the stationary part of the switch member are attached together by means of at least one attachment arrangement formed in the base member, the middle member and the protruding member.

13 Claims, 3 Drawing Sheets

SWITCHING DEVICE

CROSS-REFERENCE TO RELATED APPLICATIONS

The present application is a continuation of pending International patent application PCT/EP2009/060082 filed on Aug. 4, 2009 which designates the United States and the content of which is incorporated herein by reference.

FIELD OF THE INVENTION

The present invention relates to a mechanical switching device comprising a base member, at least one pair of elongated conductor members mounted on the base member, each conductor member comprising a conductor end, wherein the conductor ends of the pair of conductor members are separated by a gap, a middle member mounted on the base member, a switch member comprising a stationary part and a movable part, the movable part comprising a conductor bridge that is adapted to be displaced in a direction towards or away from the conductor members between a first position and a second position, wherein in the first position the two conductor ends lack electrical connection and in the second position the two conductor ends are electrical connected by means of the conductor bridge bridging over the gap between the two conductor ends.

BACKGROUND OF THE INVENTION

A mechanical switching device, such as a contactor, a relay, a contact breaker, etcetera, is a remotely operated electric switch used for establishing and disestablishing an electric connection between the gap that separates the conductor members of the pair of conductor members from each other. In case the switching device is used for a three-phase current, the switching device preferably comprises three pairs of conductor members. The conductor bridge is adapted to establishing and disestablishing the electric connection between the conductor ends of the at least one pair of conductor members by means of that the conductor bridge is displaced between the first and the second position. The conductor bridge is displaced by means of that a magnetic field is generated that creates a force that pulls the movable part towards the stationary part.

Switching devices comprise many components, such as base member, conductor members, middle member and switch member, which are assembled together. This is done by means of an attachment arrangement comprising a large number of screw joints. Each conductor member needs to be attached to the base member in a certain position so that an appropriate gap between the conductor ends of the pair of conductor members is formed. Furthermore, the middle member needs to be attached to the base member and the switch member needs to be attached to the middle member.

In order to attach each conductor member to the base member, a switching device requires one screw joint per conductor member. Thus, a switching devices with three pairs of conductor members requires 2×3 screw joints for attaching the conductor members to the base member, at least 4 screw joints for the joining the base member and the middle member and at least 4 screw joints for attaching the switch member to the middle member.

A problem with manufacturing switching devices is that the assembly of the components is time consuming due to the large number of screw joints. Moreover, switching devices need to be disassembled for maintenance and replacement of components after certain period of operation.

U.S. Pat. No. 4,100,517 presents an electrical contactor comprising a base, a pair of fixed contacts separated by a gap, a movable contact and a casing carrying a solenoid. The device further comprises two arms. Each arm is hinged at a first end to the base, wherein the arms are adapted to be pivoted so that a second end of each arm is brought to the casing. The second end of each arm is adapted to be attached to the casing by means of a screw joint so that the components of the contactor are attached together. A problem with the presented electrical contactor is that the two arms increase the complexity and the requirement on dimensional tolerance of the contactor.

SUMMARY OF THE INVENTION

The object of the present invention is an improved switching device that is easy and quick to assemble and disassemble. A further object of the invention is a switching device with a simple design that requires a small number of screw joints for holding the components of the switching device together. A further object of the invention is a switching device that requires few assembling steps to be assembled or disassembled.

This object is obtained by a switching device. The switching device is characterized in that the stationary part of the switch member comprises a protruding member protruding away from the direction of displacement of the conductor bridge, wherein the base member, the conductor members, the middle member and the stationary part of the switch member are attached together by means of at least one attachment arrangement comprising a receiving member and an insert member engaged in the receiving member, wherein the receiving member is formed in the base member, the middle member and the protruding member, and wherein the insert member extends in the receiving member.

The stationary part of the switch member forms the protruding member. The protruding member protrudes away from the direction of displacement of the conductor bridge. Thereby, the protruding member protrudes to a space not required for the function of the switch member.

The at least one attachment arrangement, comprising the receiving member and the insert member, holds the base member, the conductor members, the middle member and the stationary part of the switch member together in a desired arrangement. The receiving member is formed in the base member, the middle member and the protruding member. The receiving member receives the insert member so that the receiving member and the insert member engage and form an attachment between the base member, the middle member and the protruding part of the switch member. By means of the at least one attachment arrangement in the base member, the middle member and the protruding member, the structure of the device is simplified so that the assembling or disassembling of the device requires a reduced number of attachment arrangements and a reduced number of assembling steps compared to prior art. Thus, the production cost of the device is reduced.

The base member acts as a fundament for the conductor members. The middle member acts as a lid for the pair of conductor members. Thereby, the conductor members of the pair of conductor members are protected from foreign objects that may cause a short circuit of the conductor members.

The switch member has the function of establishing and disestablishing an electrical connection between the conductor ends of the pair of conductor members by means of that the conductor bridge is displaced between the first and the second position. The stationary part of the switch member induces a motion of the moveable part of the switch member. Thereby, the conductor bridge is displaced towards or away from the conductor members between the first and the second position. In the first position the conductor bridge is separated from the two conductor ends of the pair of conductor members, wherein the two conductor ends lack electrical connection. In the second position, the conductor bridge is simultaneously in contact with the two conductor ends of the pair of conductor members, wherein the conductor bridge is bridging over the gap so that the two conductor ends are in electrical connection with each other.

According to one embodiment of the invention, the receiving member is formed by means of a bore in each of the base member, the middle member and the protruding member, wherein the base member, the middle member and the protruding member is set in a certain arrangement in relation to each other, in which arrangement the bore in each of the base member, the middle member and the protruding member are positioned on a line or essentially on a line.

In the certain arrangement the base member, the middle member and the protruding member is positioned so that the bore extends along the line. Thereby a single straight insert member may be used to attach the base member, the middle member and the protruding member together. The bore is extending through the middle member and at least into the base member and the protruding member. The term "bore" refers to an extrusion of different geometrical configurations with different shaped cross section, such as cylindrical, rectangular, triangular cross section. The bore is preferably a cylindrical hole.

According to one embodiment of the invention, the protruding member comprises a flat part or essentially flat part that protrudes perpendicular to the direction of the displacement of the conductor bridge, wherein the receiving member is provided in the flat part. The bore extends through the flat part.

According to one embodiment of the invention, the protruding member comprises a first surface facing the middle member, the middle member comprises a second surface facing the first surface, wherein the first surface and the second surface are in contact with each other.

The first and the second surface are in direct or indirect contact with each other. Thereby, the middle member and the protruding part are in cooperation. The first and the second surface is pressed together so that the switch member is fixed on the middle member.

According to one embodiment of the invention, the insert member is a bolt. The term "bolt" refers to a protruding element of different geometrical configurations with different shaped cross section, such as cylindrical, rectangular, triangular cross section. The bolt is preferably a cylindrical pin.

According to one embodiment of the invention, the bolt and the bore is threaded, wherein the bolt and the bore form a screw joint.

According to one embodiment of the invention, the device has four attachment arrangements in the base member, the middle member and the protruding member attaching the base member, the conductor members, the middle member and the stationary part of the switch member together.

According to one embodiment of the invention, the device comprises a positioning member that positions the protruding member on the middle member in the certain position by means that at least one of the four attachment arrangements comprises an asymmetry in regards to the other three attachment arrangements.

By means of the positioning member, the protruding part is positioned in the certain position on the middle member. The asymmetry in the attachment arrangement assures that the protruding part is only positionable in the certain position on the middle member. Thereby, it is assured that the switch member is positioned in a desired position on the middle member. Thus, possible errors during assembling the switch member on the base member are prevented.

According to one embodiment of the invention, the switch member is mounted on the middle member, wherein the insert member extends in the receiving member at least from the protruding member, through the middle member and at least into the base member.

According to one embodiment of the invention, the base member and the middle member being, in cooperation with each other, adapted to hold and electrically isolate the conductor members of the pair of conductor members from each other.

The base member and the middle member, in cooperation with each other, have the function of holding the conductor members in a certain position and electrically isolate the conductor members of the pair of conductor members from each other. The base member together with the middle member creates a cover around the pair of conductor members protecting the pair of conductor members from the surrounding environment around the device.

According to one embodiment of the invention, the stationary part comprises a coil member adapted to generate a magnetic field, wherein the protruding member protrudes from the coil member. The coil member generates a magnetic field when supplied with a current. The magnetic field acts on the moveable part of the switch member so that the moveable part is displaced.

According to one embodiment of the invention, the coil member comprises a bobbin member coiled with a conductive wire, wherein the bobbin member comprises the protruding member. The bobbin member is a support for the conductive wire. The conductive wire is coiled on the bobbin member.

BRIEF DESCRIPTION OF THE DRAWINGS

The invention will now be explained more closely by the description of different embodiments, by way of example, and with reference to the appended figures.

DETAILED DESCRIPTION OF THE INVENTION

Figure 1:
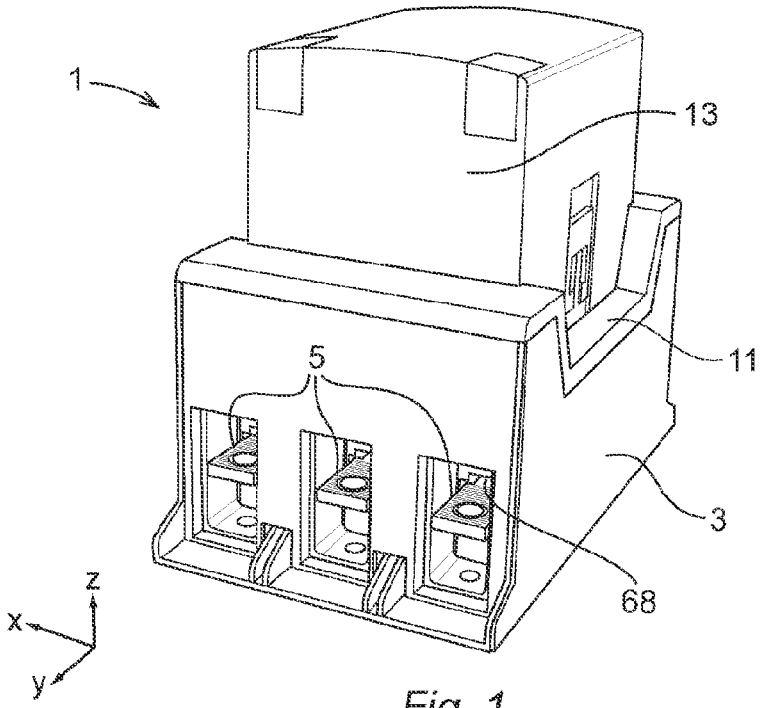
FIG. 1 shows a perspective view of a switching device.

FIG. 1 shows an example of a switching device 1 according to the invention seen from the exterior in an assembled state. The device 1 comprises a base member 3, three pairs of conductor members 5, a middle member 11 and a switch member 13. The base member 3 and the middle member 11 are preferably made of a non-conductive material such as a polymeric material, wherein the base member 3 and the middle member 11 preferably are manufactured by means of injection molding. The pair of conductor members 5 comprises an electrical conductive material, such as a copper alloy.

Two opposing sides of the base member 3 are provided with apertures 68 that receive the conductor members 5. The switch member 13 is seen with a casing that covers the interior. Each conductor member 5 is adapted to be connected to an external electric power source by means of a connection assembly such a cable clamp, cable lug, etcetera. For example, the switching device 1 is adapted to be connected to and control a three-phase current arrangement.

The device 1 further comprises four attachment arrangements adapted to hold the base member 3, the conductor members 5, the middle member 11 and the stationary part 20 of the switch member 13 together. Each attachment arrangement comprises a receiving member 40, in the disclosed embodiments in the form of a threaded bore, and a corresponding insert member 42, in the disclosed embodiments in the form of a threaded bolt. The receiving members 40 are formed in the base member 3, the middle member 11 and a protruding member 26 of the switch member 13. The insert members 42 extend in the receiving members 40 from the protruding member 26, through the middle member 11 and into the base member 3. The attachment arrangement is not visible in FIG. 1.

Figure 2:
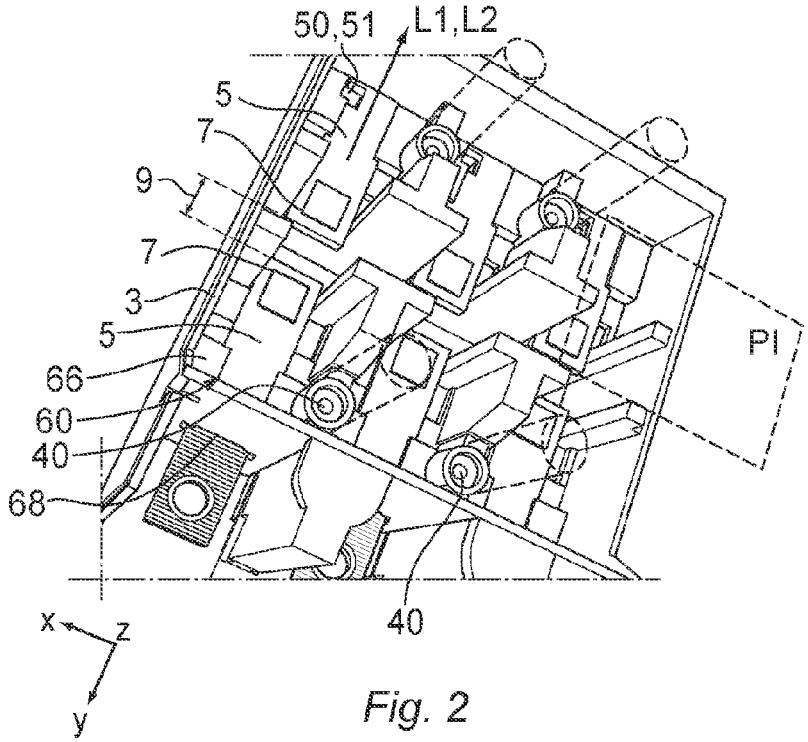
FIG. 2 shows a perspective view of a base part of the switching device.

FIG. 2 shows the base part of the switching device 1. The three pairs of conductor members 5 are arranged in a plane P1 on the base member 3. The base member 3 comprises four sides forming an open compartment. Two opposing sides of the base member 3 are provided with apertures 68. The base member 3 receives each conductor member 5 through a respective one of the apertures 68 and guides the conductor member 5 by means of a groove 60 to a certain position. At the certain position an appropriate gap 9 is formed between two conductor ends 7 of each pair of conductor members 5. Each groove 60 comprises in the embodiments disclosed two guide members 66 that prevent the conductor member 5 to slip out of the groove 60. Thereby, it is assured that the conductor member 5 is positioned parallel with the extension of the groove 60 and parallel with the plane P1.

The groove 60 comprises a longitudinal axis L2 that is parallel with a longitudinal axis L1 of the conductor member 5. The pair of conductor members 5 is positioned parallel with a plane P1, wherein the longitudinal axis L2 of the groove 60 is parallel with the plane P1. The groove 60 comprises a bottom surface that supports the conductor members 5. The groove 60 also comprises two side parts with a corresponding side surface. The side surfaces are perpendicular to the bottom surface. The bottom surface and the side surfaces are perpendicular to the longitudinal axis L2 of the groove 60. The groove 60 is arranged so that the conductor member 5 is in friction contact with the bottom surface 62 and the side surfaces.

The groove 60 comprises the guide member 66 that protrudes out from each of the side parts 64. The guide members 66 protrude essentially parallel with the plane P1 of the conductor members 5. The guide members 66 guide the conductor member 5 during insertion in the groove 60 and prevent the conductor member 5 from slipping out of the groove 60. The guide member 66 comprises a guide surface directed towards the conductor member 5. The guide surface is in friction contact with an upper side of the conductor member 5.

Each conductor member 5 is provided with a through opening 50 adapted to receive a protruding part 52 of the middle member 11 at the certain position. Furthermore, the base member 3 comprises a recess 51 adapted to receive the protruding part 52 of the middle member 11. The opening 50 in the conductor member 5 and the recess 51 in the base member 3 are positioned on a line in the certain position of each conductor member 5. Each conductor member 5 is fixed within its groove 60 between the base member 3 and the middle member 11 by means of that the protruding part 52 is received by the opening 50 of the conductor member 5 and the recess 51 of the base member 3. Thereby, the conductor member 5 is prevented from being pulled out of the groove 60 and the aperture 68. Likewise, the conductor member 5 is prevented from being pushed further inside the groove 60 of the base member 3. Thus, the gap 9 between the conductor ends 7 of the pair of conductor members 5 is set to a certain distance.

The base member 3 and the middle member 11 are adapted to be attached together by means of four attachment arrangements. Each attachment arrangement comprises the receiving member 40 and the insert member 42. The receiving members 40 are formed in the base member 3. The attachment arrangements create a force that holds the base member 3 and the middle member 11 together so that a clamping surface 54 for each conductor member 5 acts on the conductor members 5 so that the conductor members 5 are clamped between the base member 3 and the middle member 11 at a fixed position within the groove 60. Thereby, each conductor member 5 will be prevented from movements within the groove 60.

Figure 3:
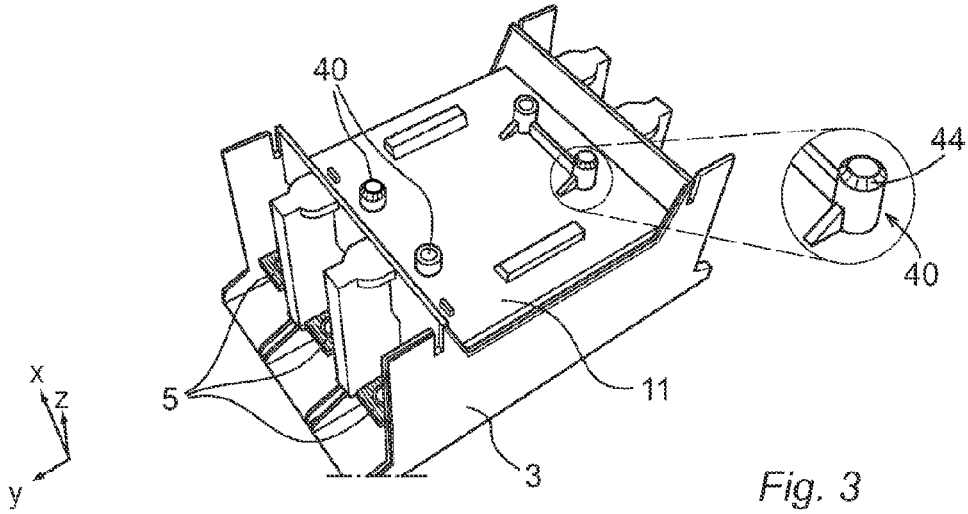
FIG. 3 shows a perspective view of a middle part of the switching device.

FIG. 3 shows an upper side of the middle member 11. The middle member 11 is positioned on the base member 3 so that the pairs of conductor members 5 are clamped between the base member 3 and the middle member 11. The middle member 11 comprises four receiving members 40 in the form of bores. The receiving members 40 are positioned in a rectangular pattern. The receiving members 40 comprise a positioning member formed by an asymmetry by means of that two of the receiving members 40 of the middle member 11 comprise a male member 44 adapted to receive a female member 46 on a receiving member 40 of the switch member 13 shown in FIG. 4. The other two receiving members 40 lack the male member 44. Thereby, it is assured that the protruding member 26 of the switch member 13 is mounted in a certain position on the middle member 11. In the example, the receiving members 40 provided with the male member 44 are positioned diagonally. However, other pattern of the positioning member is possible. For example, a single male member 44 is sufficient to provide the asymmetry needed in order to assure the certain position of the protruding member 26 on the middle member 11 is obtained.

Figure 4A:
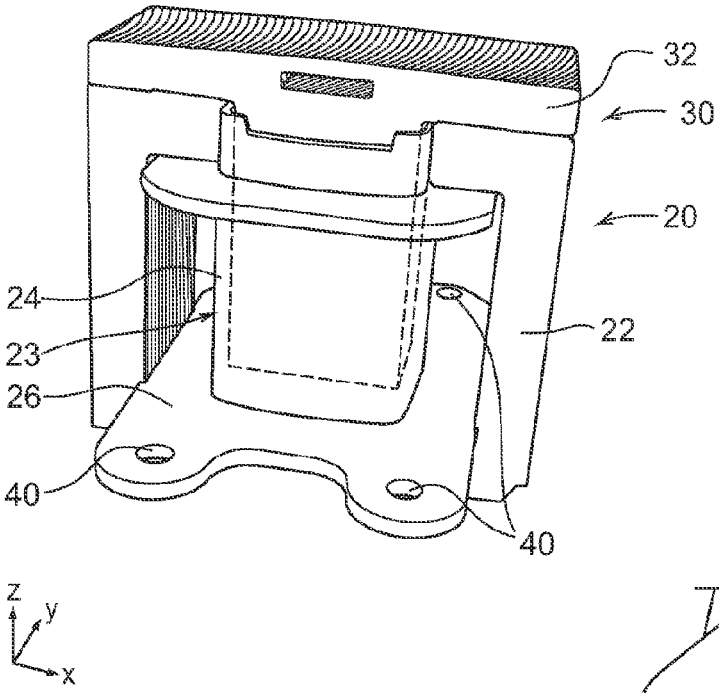
FIG. 4*a* shows a perspective view of a switch member of the switching device from a front side.
Figure 4B:
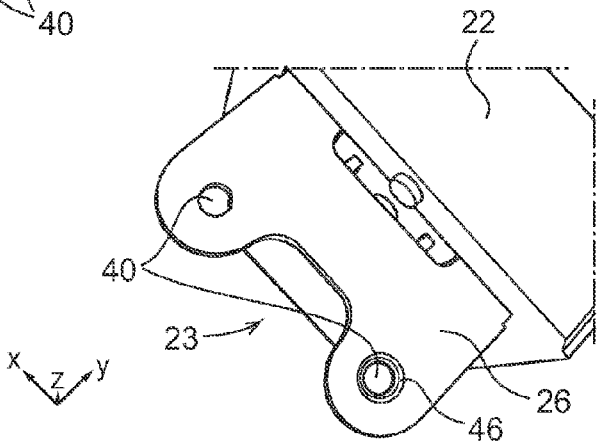
FIG. 4*b* shows a perspective view of a switch member of the switching device from a bottom side.

FIG. 4*a* shows the switch member 13 of the switching device 1 from a front side. The function of the components of the switch member 13 will be further discussed in FIG. 6. The protruding member 26 protrudes away from the switch member 13. The protruding member 26 is provide with four receiving member 40 in the form of bores. The receiving members 40 are positioned in a rectangular pattern corresponding to the pattern of receiving member 40 of the middle member 11. FIG. 4*b* shows a part of the switch member 13 of the switching device 1 from a bottom side. The receiving members 40 of the protruding member 26 comprise an asymmetry by means of that two of the four receiving members 40 comprise the female member 46 adapted to receive the male member 44 of the middle member 11. The female member 46 is formed by means of a countersink in the bore.

Figure 5:
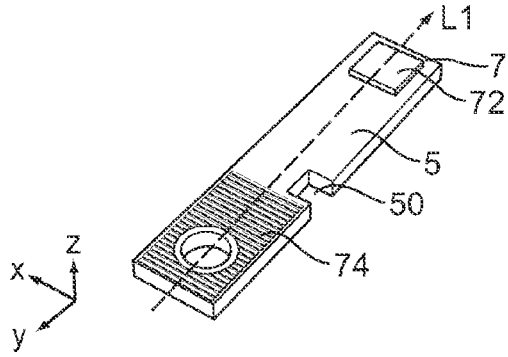
FIG. 5 shows perspective view of a conductor member of the switching device.

FIG. 5 shows an example of the conductor member 5. The conductor member 5 has a flat elongated form with a longitudinal axis L1. The opening 50 is provided on a side part of the conductor member 5. The conductor member 5 comprises a conductor end 7 that is adapted to face the opposing conductor end 7 of the pair of conductor members 5. The conductor end 7 is provided with sheet metal shield 72 that is adapted to get in contact with a corresponding sheet metal shield of the conductor bridge 34. The conductor member 5 further comprises a connection end 74 on the opposite side of the conductor end 7. The connection end 74 is adapted to be connected to external power. The connection end 74 is provided with a through hole that is adapted to receive the connection assembly such a cable clamp, cable lug, etcetera.

Figure 6:
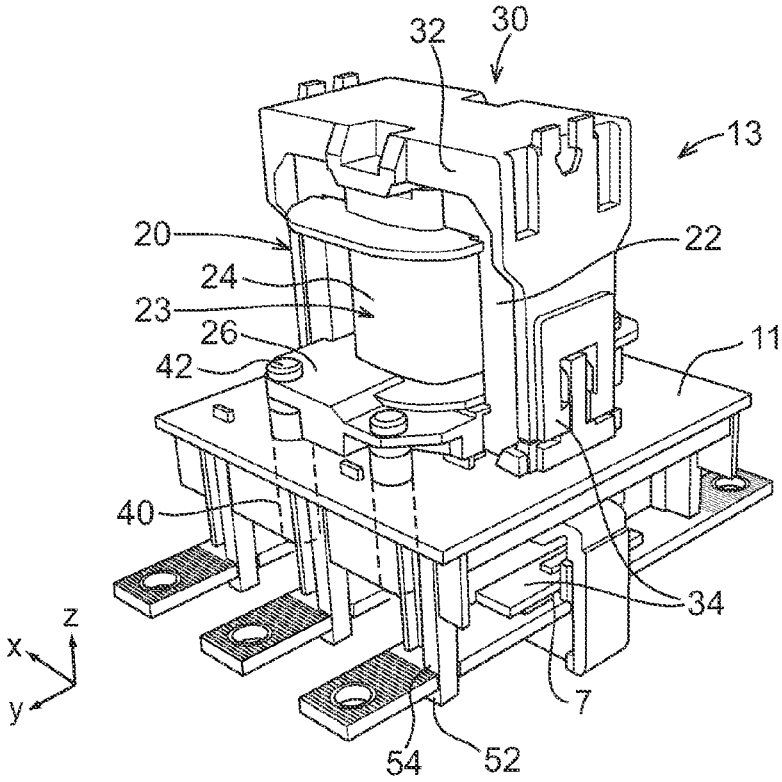
FIG. 6 shows perspective view of a switch member of the switching device.

FIG. 6 shows the switch member 13 mounted on the middle member 11. The switch member 13 comprises the stationary part 20 and the movable part 30. The movable part 30 comprises a conductor bridge 34 that is adapted to be displaced in a direction towards or away from the conductor members 5 between a first position and a second position, wherein in the first position the two conductor ends 7 lack electrical connection and in the second position the two conductor ends 7 are electrical connected by means of the conductor bridge 34 bridging over the gap 9 between the two conductor ends 7 of each pair of conductor members 5.

The stationary part 20 of the switch member 13 further comprises a stationary magnetic part 22 and an electric coil member 23. The stationary magnetic part 22 has a U-shaped form and is made of a ferromagnetic material such as iron. The coil member 23 comprises a bobbin member 24 with a conductive wire coiled around the bobbin member 24. The conductive wire is supplied with a current so that the coil member 23 creates a magnetic field. The coil member 23 is positioned inside the open space of the U-shaped stationary magnetic part 22.

The movable part 30 comprises a movable magnetic part 32 and the conductor bridge 34. The movable magnetic part 32 has a T-shaped form and is made of a ferromagnetic material such as iron. The movable magnetic part 32 is adapted to be displaced inside the coil member 23 by means of that the magnetic field created by the coil member 23 pulls the movable magnetic part 32 towards the stationary magnetic part 22 so that the T-formed part enters into the U-formed part. The conductor bridge 34 is connected to the movable magnetic part 32 and is moved towards and away from the conductor members 5 so that an electrical connection is established respectively disestablished.

The bobbin member 24 has a protruding member 26 that protrudes parallel with the upper side of the middle member 11. The base member 3, the middle member 11 and the protruding member 26 is attached together by means of the attachment arrangement. Four insert members 42 in the form of bolts is shown. The insert member 42 extends into the receiving members 40 formed in the base member 3, the middle member 11 and the protruding member 26 of the switch member 13. The base member 3 and the middle member 11 form a compartment that protects the conductor members 5 from foreign elements that may cause a short circuit.

On a lower part of the middle member 11 is one conductor member 5 shown in order to illustrate the connection between the base member 3, the conductor members 5 and the middle member 11. The middle member 11 comprises a protruding part 52 that is received by the opening 50 on the conductor member 5 and protrudes through the conductor member 5. The protruding part 52 is extending through the conductor member 5 and is adapted to be received by the recess 51 of the base member 3. The clamping surface 54 bears against an upper side of the conductor member 5 and is adapted to press the conductor member 5 downwards into the groove 60 of the base member 3 so that the conductor member 5 is clamped between the base member 3 and the middle member 11. Thereby, each conductor members 5 is fixed in its groove 60 by means of friction contact between the groove 60 and the conductor member 5.

An upper part of the middle member 11 comprises an upper side that acts as a cover that protects the conductor member 5 from foreign elements. The upper side of the middle member 11 supports a stationary part 20 of the switch member 13. The middle member 11 further forms four receiving members 40 that receive corresponding insert members 42 for holding the device 1 together. The middle member 11 comprises a passage for the conductor bridge 34 for each pair of conductor members 5. The conductor bridge 34 is adapted to establish and disestablish an electrical connection between the conductor ends 7 of the pair of conductor members 5.

The present invention is not limited to the embodiments disclosed but may be varied and modified within the scope of the following claims.

What is claimed is:

1. A mechanical switching device comprising:

a base member, at least one pair of elongated conductor members mounted on the base member, each conductor member comprising a conductor end, wherein the conductor ends of the pair of conductor members are separated by a gap, a middle member mounted on the base member, a switch member comprising a stationary part and a movable part, the movable part comprising a conductor bridge that is adapted to be displaced in a direction towards or away from the conductor members between a first position and a second position, wherein in the first position the two conductor ends lack electrical connection and in the second position the two conductor ends are electrical connected by means of the conductor bridge bridging over the gap between the two conductor ends, characterized in that said stationary part comprises a protruding member protruding away from the direction of displacement of the conductor bridge, wherein the base member, the conductor members, the middle member and the stationary part of the switch member are attached together by means of at least one attachment arrangement comprising a receiving member and an insert member engaged in the receiving member, wherein the receiving member is formed in the base member, the middle member and the protruding member, and wherein the insert member extends in the receiving member.

2. The mechanical switching device according to claim 1, characterized in that the receiving member is formed by means of a bore in each of the base member, the middle member and the protruding member, wherein the base member, the middle member and the protruding member is set in a certain arrangement in relation to each other, in which arrangement the bore in each of the base member, the middle member and the protruding member are positioned on a line.

3. The mechanical switching device according to claim 1, characterized in that the protruding member comprises a flat part that protrudes perpendicular to the direction of the displacement of the conductor bridge, wherein the receiving member is provided in the flat part.

4. The mechanical switching device according to claim 3, characterized in that the bore extends through the flat part.

5. The mechanical switching device according to claim 1, characterized in that the protruding member comprises a first surface facing the middle member, the middle member comprises a second surface facing the first surface, wherein the first surface and the second surface are in contact with each other.

6. The mechanical switching device according to claim 1, characterized in that said insert member is a bolt.

7. The mechanical switching device according to claim 6, characterized in that the bolt and the bore is threaded, wherein the bolt and the bore form a screw joint.

8. The mechanical switching device according to claim 1, characterized in that the device has four attachment arrangements in the base member, the middle member and the protruding member attaching the base member, the conductor members, the middle member and the stationary part of the switch member together.

9. The mechanical switching device according to claim 8, characterized in that the device comprises a positioning member that positions the protruding member on the middle member in the certain position by means that at least one of the four attachment arrangements comprises an asymmetry in regards to the other three attachment arrangements.

10. The mechanical switching device according to claim 1, characterized in that the switch member is mounted on the middle member, wherein the insert member extends in the receiving member at least from the protruding member, through the middle member at least into the base member.

11. The mechanical switching device according to claim 1, characterized in that the base member and the middle member being, in cooperation with each other, adapted to hold and electrically isolate the conductor members of the pair of conductor members from each other.

12. The mechanical switching device according to claim 1, characterized in that the stationary part comprises a coil member adapted to generate a magnetic field, wherein the protruding member talyprotrudes from the coil member.

13. The mechanical switching device according to claim 1, characterized in that the coil member comprises a bobbin member coiled with a conductive wire, wherein the bobbin member comprises the protruding member.

* * * * *